United States Patent [19]

Singh

[11] 4,259,988

[45] Apr. 7, 1981

[54] VORTEX-DIODE CHECK VALVE WITH FLEXIBLE DIAPHRAGM

[75] Inventor: Param I. Singh, Lexington, Mass.

[73] Assignee: Avco Everett Research Laboratory, Inc., Everett, Mass.

[21] Appl. No.: 76,385

[22] Filed: Sep. 17, 1979

[51] Int. Cl.[3] ..... F15C 1/16

[52] U.S. Cl. ..... 137/812; 137/813

[58] Field of Search ..... 137/808, 809, 810, 811, 137/812, 813; 251/61.1

[56] References Cited

U.S. PATENT DOCUMENTS

| | | | |
|---|---|---|---|
| Re. 26,876 | 5/1970 | Adams et al. . | |
| 2,704,548 | 3/1955 | Ralston . | |
| 3,521,657 | 7/1970 | Ayers . | |
| 3,712,318 | 1/1973 | Kopera | 137/810 X |
| 4,003,405 | 1/1977 | Hayes | 137/810 X |
| 4,073,316 | 2/1978 | Nystrom | 137/813 X |
| 4,112,977 | 9/1978 | Syred et al. | 137/812 |

OTHER PUBLICATIONS

Paul, F. W. "Survey of Steady-State Fluidic Diode Performance" ASME Paper 69-WA/Flcs-14 (1969).

Yastrebova, E. V., "Fluid Diodes", Automation and Remote Control, Mar. 1971, pp. 435-439, UDC 62-522.

Schwartz, G. J. and Wieting, D. W. "A Vortex Diode Used as the Outflow Valve for Pulsatile Blood Pumps", Proceedings of the 30th ACEMB, Los Angeles, Nov. 1977, p. 349.

*Primary Examiner*—William R. Cline

*Attorney, Agent, or Firm*—Melvin E. Frederick

[57] ABSTRACT

A vortex-diode check valve comprises a short cylindrical working chamber with an axial inlet port entering axially through a first end wall at a short distance from the central portion of a second end wall and a tangential outlet port exiting tangentially through a circular side wall. The ratio of fluid flow resistances, between flows in the reverse and forward directions, is markedly increased by configuring at least one end wall as a flexible resilient diaphragm, permitting relative motion between the second end wall and the axial inlet port.

12 Claims, 4 Drawing Figures

VORTEX-DIODE CHECK VALVE WITH FLEXIBLE DIAPHRAGM

BACKGROUND OF THE INVENTION

1. Field of the Invention

This invention relates to check valves, that is, fluid flow control devices which permit flow through a conduit in predominantly only on direction. More particularly, this invention relates to check valves suitable for use in circulatory assist devices such as cardiopulmonary bypass machines for use during cardiac surgery, and extracorporeal assist circuits for extended clinical cardiac support. Still more particularly, this invention relates to such check valves which can provide minimal hemolysis and thrombogenesis, and acceptably high fluid-dynamic efficiency and durability.

2. Prior Art Problems

Problems usually encountered in check valves, used in circulatory assist devices, include hemolysis, thrombsis and mechanical fatigue failure. Well-known experimental results show that accelerated hemolysis rates may be avoided if fluid shear rates are kept below $10^4$ $sec^{-1}$. Further experimental results indicate that thrombogenesis may be significantly decreased if blood-contacting surfaces are smooth on a scale comparable to cellular dimensions and if fluid shear rates are everywhere kept above 10 $sec^{-1}$. To exploit the consequent range of acceptable shear rates, it is necessary to avoid valve geometries which give rise to regions of separated, retrograde or persistently stagnated flow, such as occur in strut wakes and blood-wetted notches, on the one hand, or those which give rise to excessive shear rates, such as small orifices, on the other. Additionally, it is necessary that cyclic material stresses be kept low, and that rubbing and striking of surfaces be avoided, in order to provide sufficient device durability.

Fluidic valves generally have no moving solid parts and can have simple smooth geometry; such properties are potentially useful for use with blood. Among the fluidic check valves, also called fluid diodes by analogy with electronic components, perhaps the most attractive is the so-called vortex diode. This device is compact and simple to construct and can maintain an internal fluid motion at all times, even during the intervals between pulses of fluid conduction usually referred to as diastole, by analogy to the functions of the natural heart. Therefore, the vortex diode has been considered for use with pulsatile blood pumps. Its major drawback is that, for flow rates of physiological interest, the diodicity of the device, defined as the ratio of fluid flow resistances in the reverse and forward flow directions, is generally below 5, resulting in substantial reverse flows or regurgitation. While the detailed fluid flow in such devices is rather complex, a reasonably complete analysis indicates that even for an ideal vortex diode with no frictional losses, for a size appropriate for a circulatory assist device, the diodicity could scarcely exceed 10, so the performance limitation is fundamental. For more physiological performance, a diodicity of the order of 20, or more, would be preferred.

SUMMARY OF THE INVENTION

It is therefore the general object of this invention to provide a check valve for use with blood, having compactness and simplicity equal to that of a vortex diode, but also having a higher diodicity. It is a further object of this invention to provide a check valve which causes minimal hemolysis and thrombogenesis and which exhibits adequate durability.

According to this invention, these objects are achieved by reconfiguring a vortex diode so that at least one of the end walls, normal to the axis of the device, is replaced by a flexible resilient membrane or diaphragm smoothly shaped to conform to the mean flow and to permit diaphragm motion toward the facing end wall. Thereby, the radial pressure gradients, resulting from the vortex motion set up by fluid flow in the reverse or high-fluid-resistance direction, move the flexible diaphragm so as to cause increased partial occlusion of the entrance to the axial inlet port of the diode, thus increasing up to about full constriction the reverse resistance and the diodicity.

It is to be understood that this improvement is applicable to check valves used in applications other than in blood-handling devices. However, in the interest of simplicity, the device and its improved characteristics will be described in that context.

DETAILED DESCRIPTION

Figure 1:
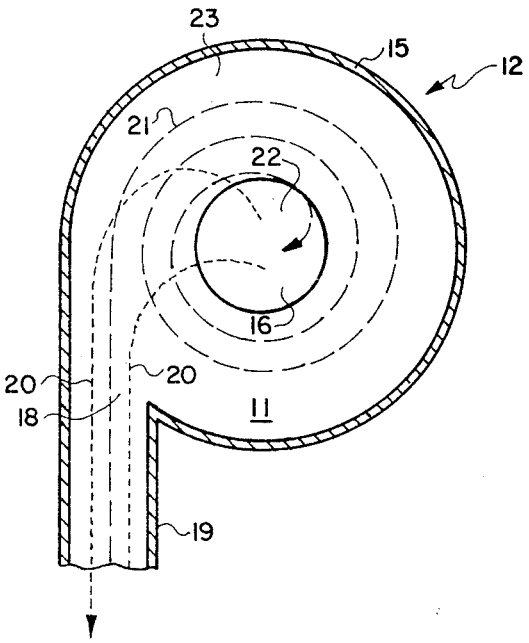
PRIOR ART Fig 1
FIG. 1 is a schematic cross-section view, normal to the axis, of a prior art simple vortex diode.
Figure 2:
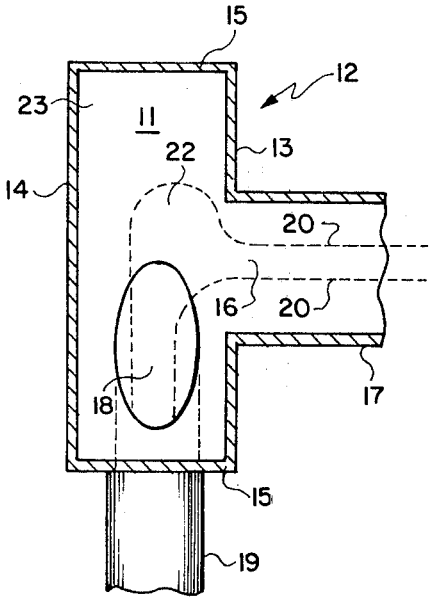
PRIOR ART Fig 2
FIG. 2 is a corresponding schematic cross-section view, parallel to the axis, of the vortex diode of FIG. 1.

Reference is first made to FIGS. 1 and 2, which are schematic cross-section views, respectively normal to and parallel to the axis of a prior art simple vortex diode. The device comprises a cylindrical working chamber 11 short in the axial direction defined by a rigid shell 12, having two end walls 13 and 14 and a circular side wall 15. An axial inlet port 16 enters axially through end wall 13 and is connected to inlet duct 17. A tangential outlet port 18 exits tangentially through circular side wall 15 and is connected to outlet duct 19.

When fluid is passed through the device in the forward direction, that is, from inlet duct 17 to outlet duct 19, the flow is fairly gently diffuse, as typified by the dotted lines 20 in FIGS. 1 and 2, and there is very little fluid flow resistance. However, when fluid is passed through the device in the reverse direction, the flow is quite different. The character of the flow is typified by the dashed lines 21 in FIG. 1. Fluid entering through port 18 is turned by circular side wall 15 to set up a strongly rotating flow. By conservation of rotational momentum, as the flow circles inward toward port 16, the tangential flow velocity increases as the radius decreases. By Bernoulli's principle, there is a fluid pressure drop proportional to the square of that flow velocity, leading to a strong radial pressure gradient, with lower pressure in region 22 near port 16 and the axis of the device, than in region 23, near the periphery of working chamber 11. This pressure gradient strongly opposes the reverse flow through the device, so that the vortex diode may exhibit a technically useful diodicity, defined as the ratio of resistance to flow in the reverse direction, to resistance to flow in the forward direction.

Working chamber 11 may be configured with smoothly curved inner contours to avoid corners where blood may clot. Observation shows that, when subjected to pulsatile flows typical of blood circulation, the flow pattern in chamber 11 may be gentle but persistant, providing constantly the desired range of fluid shear rate. Indeed, the vortex flow set up during periods of reverse flow may be observed to persist somewhat during periods of forward flow. And by asymmetry of the device, the possible flow stagnation point near the middle of end wall 14 may be observed to move about during the cycle of operation, thus removing the one possible point of stasis. The vortex diode is therefore well adapted to use in circulatory assist devices, except for one limitation: the diodicity is not as high as would be preferred for such purposes, leading to excessive pressure and volume losses during periods of reverse flow.

Figure 3:
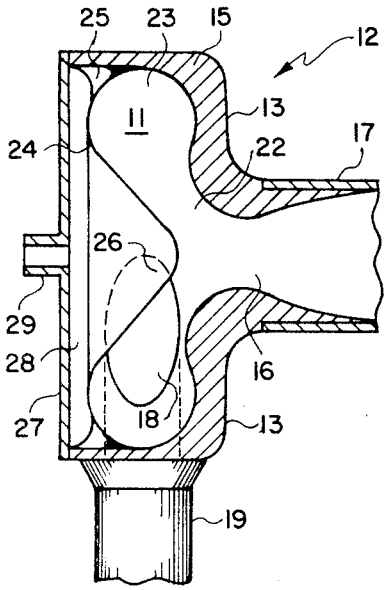
FIG. 3 is a schematic cross-section view, parallel to the axis, of an improved vortex diode according to this invention.

Reference is now made to FIG. 3, which is a schematic cross-section view parallel to the axis of an improved vortex diode according to this invention. This view is not necessarily to scale, chamber 11 being drawn somewhat expanded axially in the interest of clarity. Rigid shell 12 is designed with smoothly curved inner contours so that side wall 15 fairs into end wall 13 which in turn defines a smooth inlet port 16 with gentle contours leading to inlet duct 17, and also so that side wall 15 defines a smooth outlet port 18 with gentle contours leading to outlet duct 19. Rigid end wall 14 has here been replaced by flexible resilient diaphragm 24 which has a thickened rim 25 which is faired into side wall 15 to which it is attached, typically by cementing. Diaphragm 24 is so shaped that, in its equilibrium zero-flow position, central portion 26 is located at a short distance, of the order of the radius of inlet port 16, from the entrance of axial inlet port 16 into working chamber 11. Diaphragm 24 conveniently is made generally cone-shaped in the direction of inlet port 16 as shown in FIG. 3. Rigid shell 12 is further extended, and closed by lid 27 to define a reference chamber 28 which may be connected through tubulation 29 to a source of reference pressure or volume.

When fluid is passed through this device in the forward direction, the flow is similar to that in prior art vortex diodes, being a fairly gentle diffuse flow from inlet duct 17 to outlet duct 19. Because of the slight pressure gradient through the device, with the higher pressure in region 22 near inlet port 16, central portion 26 of diaphragm 24 may retreat slightly from inlet port 16, thus somewhat facilitating the flow; the difference is very slight. However, for a given flow rate through the device in the reverse direction, the flow differs importantly from that in prior art vortex diodes. The strong radial pressure gradient, with lower pressure in region 22 near port 16, urges central portion 26 of diaphragm 24 strongly toward the entrance of inlet port 16, thus further constricting that entrance. The resulting increase of fluid velocity yields a further increase of pressure gradient in accordance with Bernoulli's principle in addition to a further increase due to viscous fluid drag. The overall result is marked increase in fluid flow resistance to such reverse flow, and a concomitant increase in device diodicity.

Selectively variable pressure may be applied through tubulation 29 to adjust the equilibrium position of diaphragm 24. Alternatively, a selectively variable volume of fluid may be maintained in reference chamber 28. In a device for use with blood, reference chamber 28 may preferably be filled with saline solution and tubulation 29 be sealably closed with a stopper. When such a device is operated, the radial pressure gradient in working chamber 11 causes central portion 26 of diaphragm 24 to move in one direction while the peripheral portion of diaphragm 24 moves in the opposite direction. The latter movement is relatively slight, due to the larger area of the peripheral portion.

There are several methods for providing a very smooth surface of blood-compatible material in the interior of chamber 11, ports 16 and 18, and ducts 17 and 19. One simple method is to assemble the device as shown, pour a small quantity of a solution of blood-compatible elastomer into the working chamber and ducts of the device and rotatably manipulate it so that all inner surfaces are covered and all crevices filled, decant the excess solution, and allow the coating to dry, continuing to manipulate to prevent pooling, and taking care that diaphragm 24 is neither wrinkled nor touching the entrance of port 16.

Figure 4:
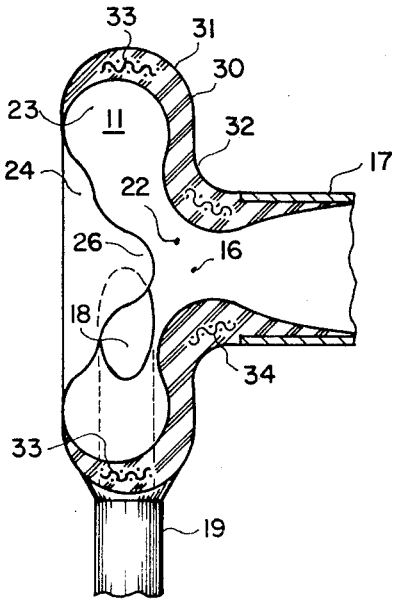
FIG. 4 is a schematic cross-section view, parallel to the axis, of an alternative improved vortex diode according to this invention.

Attention is now directed to FIG. 4, which is a schematic cross-section view parallel to the axis of an alternative improved vortex diode according to this invention. Again, this view is not necessarily to scale. Rigid shell 12 is here replaced by a flexible shell 30 comprising circular side wall 31, flexible diaphragm 24 and slightly flexible end wall 32. This whole assembly is preferably a monolithic construction of elastomeric material, stiffened as appropriate by bands of fabric or the like, as in the side walls at 33 and surrounding port 16 at 34. This form of the improved vortex diode may be applicable for in vivo implantation in a softly yielding environment, which would therefore define the mean external pressure upon diaphragm 24.

This invention has been described in terms of two typical embodiments and in the context of use as a blood-compatible check valve. Other embodiments and uses will undoubtedly occur to those skilled in the relevant arts, given the foregoing description and teaching, all of which embodiments and uses may be achieved without departing from the spirit and scope of the invention as defined by the following claims:

I claim:

1. A vortex diode for controlling flow of a fluid and having a circular side wall, a first end wall and a second end wall defining a short cylindrical working chamber, an axial inlet port entering axially through said first end wall of said working chamber, and a tangential outlet port exiting tangentially through said circular side wall of said working chamber, said vortex diode exhibiting, in said fluid in said working chamber, a radial pressure gradient which is of greater magnitude, when said flow of fluid is from said outlet port to said inlet port, than when said flow of fluid is from said inlet port to said outlet port, said vortex diode being further characterized by:

(a) said axial inlet port through said first end wall of said working chamber being positioned at a short distance from said second end wall of said working chamber;

(b) at least one end wall, of said first end wall and said second end wall, being a flexible diaphragm, permitting variation of said short distance; and (c) said flexible diaphragm being responsive to said radial pressure gradient to diminish said short distance when said flow of fluid is from said outlet port to said inlet port.

2. A vortex diode as set forth in claim 1 wherein said flexible diaphragm permits variation of said short distance to at least about full constriction of said inlet port.

3. A vortex diode as set forth in claim 1, further characterized by:

(a) said first end wall being relatively rigid; and (b) said second end wall being a flexible diaphragm.

4. A vortex diode as set forth in claim 3 wherein said flexible diaphragm is generally cone-shaped in the direction of said inlet port.

5. A vortex diode as set forth in claim 4 wherein said generally cone-shaped flexible diaphragm terminates in a central portion and its equilibrium zero-flow position is disposed a distance from said inlet port of the order of the radius of said inlet port.

6. A vortex diode as set forth in claim 3 further comprising:

(a) an extension of said circular side wall and a circular lid which, together with said flexible diaphragm, define a reference chamber on that side of said diaphragm opposite said working chamber.

7. A vortex diode as set forth in claim 6, further comprising:

(a) a tubulation connected to said reference chamber for introducing a reference fluid pressure into said reference chamber.

8. A vortex diode as set forth in claim 6, further comprising:

(a) a tubulation connected to said reference chamber for introducing a reference fluid volume into said reference chamber.

9. A vortex diode as set forth in claim 6, further comprising:

(a) a fixed volume of fluid occupying said reference chamber.

10. A vortex diode as set forth in claim 1, further characterized by:

(a) said circular side wall and said first and second end walls being made of a continuous body of elastomeric material; and (b) said axial inlet port and said tangential output port being defined by said body of elastomeric material.

11. A vortex diode as set forth in claim 10, further comprising:

(a) reinforcement embedded in said body of elastomeric material in the region of said circular side wall.

12. A vortex diode as set forth in claim 10, further comprising:

(a) reinforcement in said body of elastomeric material in the region defining said axial inlet port.

* * * * *

UNITED STATES PATENT AND TRADEMARK OFFICE

CERTIFICATE OF CORRECTION

PATENT NO. : 4,259,988

DATED : April 7, 1981

INVENTOR(S) : Param I. Singh

It is certified that error appears in the above-identified patent and that said Letters Patent are hereby corrected as shown below:

Column 1, line 9, please change "on" to ---one---.

Signed and Sealed this

*Sixteenth* Day of *June 1981*

[SEAL]

*Attest:*

RENE D. TEGTMEYER

*Attesting Officer*

*Acting Commissioner of Patents and Trademarks*